United States Patent [19]

Hamburg et al.

[11] 4,033,789

[45] July 5, 1977

[54] METHOD OF PRODUCING A HIGH STRENGTH STEEL HAVING UNIFORM ELONGATION

[75] Inventors: Emil G. Hamburg, Pittsburgh; Robert L. Cryderman, McMurray; John F. Butler, Bethel Park, all of Pa.

[73] Assignee: Jones & Laughlin Steel Corporation, Pittsburgh, Pa.

[22] Filed: Mar. 19, 1976

[21] Appl. No.: 668,374

[52] U.S. Cl. ..... 148/12 F; 75/123 M; 148/36; 148/134

[51] Int. Cl.[2] ..... C21D 6/00; C21D 7/14

[58] Field of Search ..... 148/36, 12 F, 134; 75/123 B, 123 N, 123 J, 123 M

[56] References Cited

UNITED STATES PATENTS

| | | | |
|---|---|---|---|
| 3,625,780 | 12/1971 | Bosch et al. | 148/12 F |
| 3,830,669 | 8/1974 | Matsuoka et al. | 148/12 F |
| 3,902,927 | 9/1975 | Pernstal | 148/12 F |

FOREIGN PATENTS OR APPLICATIONS

| | | | |
|---|---|---|---|
| 1,118,662 | 7/1968 | United Kingdom | 148/12 F |

OTHER PUBLICATIONS

Hayami; "A Family of High-Strength, Cold-Rolled Steels," 10/75, Micro Alloying 75, pp. 78–87.

Rashid; "GM 980X-A Unique High Strength Sheet Steel With Superior Formability," Soc. of Auto. Engr. Inc., Feb., 1976.

*Primary Examiner*—Arthur J. Steiner

*Attorney, Agent, or Firm*—Gerald K. White; T. A. Zalenski

[57] ABSTRACT

A steel product having a combination of high strength and formability (as measured by percent tensile uniform elongation) is produced by austenitizing a steel consisting essentially of from 0.04 to 0.17% carbon, 0.8 to 2.0% manganese, up to 1.0% silicon, up to 0.12% vanadium, up to 0.1% columbium, up to an effective amount of titanium to form titanium carbonitrides, 0.001 to 0.025% nitrogen, balance essentially iron and then cooling at a rate of no more than about 70° F/sec. to about 850° F and at a rate of more than about 10° F/sec. to transform the freshly formed austenite to a microstructure of from 10 to 35% by volume of martensite and/or lower bainite (MLB), balance essentially proeutectoid ferrite. Slower cooling rates may be employed to obtain the desired microstructure if a restricted chemical composition is used. The heat-treated steel product is characterized by an ultimate tensile strength of 80,000 p.s.i. minimum and a uniform elongation of 16% minimum.

7 Claims, 5 Drawing Figures

METHOD OF PRODUCING A HIGH STRENGTH STEEL HAVING UNIFORM ELONGATION

This invention is related to the field of the heat-treatment of high strength steel products for purposes of achieving a highly desirable combination of high strength and formability. This combination of mechanical properties enables one to produce a high strength steel that can be formed with the ease of a significantly lower strength steel.

The results of the invention are achieved through use of a heat-treatment superficially similar to the well known technique of normalizing. Normalizing broadly involves heating ferrous alloys to a temperature above the transformation range and then air cooling to a temperature substantially below the transformation range for the purpose of achieving a pearlitic microstructure. On the other hand, the heat-treating procedure of the invention heats the steel to above the $Ac_3$ temperature for a sufficient time to transform the prior microstructure to austenite and then utilizes controlled cooling at rates related to steel composition to obtain a microstructure of from 10 to 35% by volume of low temperature constituents such as martensite and/or lower bainite (MLB) with the remainder essentially constituting proeutectoid ferrite. It has been discovered that such microstructure results in excellent formability in combiation with high strength. This combination enables use of the steel of the invention for difficult forming applications including wheel discs and bumpers. For example, as formed steels of the invention may be directly used for automotive applications that formerly required low carbon steels that were strengthened after forming by carburization. The product of the invention is also highly suitable for other light-weight structural applications in which high strength to weight ratios are desired. Inasmuch as the inventive product has a minimum ultimate tensile strength of about 80,000 p.s.i., a minimum tensle uniform elongation of 16%, it is considered to represent a significant advance in the art when contrasted to commercially available steel products having comparable strength levels. A 16% minimum tensile uniform elongation is also considered to be representative of material having good formability in the context of the applications described above.

FIG. 1 graphically illustrates the improvement in tensile uniform elongation vs. ultimate tensile strength attained through practice of the invention when contrasted with typical ferrite-pearlite steels of the prior art. The solid curve represents steel products of the invention in the hot-rolled and heat-treated condition while the dashed curve depicts typical commercially available steel products having ferrite-pearlite microstructures in the hot-rolled condition. The upper and middle portions of the dashed curve represent conventional high-strength low alloy steels and the lower portion illustrates typical mechanical properties for aluminum killed low-carbon steels. As may be noted, the steel product of the invention is characterized by significantly improved tensile uniform elongation when compared with the same strength level of the ferrite-pearlite steels of the prior art.

Various heat-treatments have been proposed for steels of the general type of the invention. However, it is believed that such heat-treatments either do not recognize and capitalize upon the discovered critical relatonship between volume % MLB and the combination of high strength and formability or involve attempts to minimize the occurrence of low temperature transformation products such as martensite or lower bainite. Typical of heat-treating procedures that do not appear to involve formation of martensite or lower bainite are U.S. Pat. No. 3,914,135 and that disclosed by M. S. Rashid, General Motors Corporation, Warren, Mich. in a publication entitled, "GM 980X — A Unique High Strength Sheet Steel with Superior Formatility." On the other hand, U.S. Pat. Nos. 3,830,669, 3,902,927, 3,928,086 and 3,930,907 as well as S. Hayami and T. Furukawa, Nippon Steel Corporation, Tokyo, Japan, in Micro Alloying 75, pages 78–87 entitled "A Family of High-strength, Cold-Rolled Steels" involve discussions of various heat-treatments that appear to involve the presence of low temperature transformation micro constituents.

It is an object of this invention to produce a high strength steel product characterized by excellent formability as measured by uniform elongation. Such product should desirably have an ultimate tensile strength of 80,000 p.s.i. minimum and 16% uniform elongation minimum.

It is an additional objective to produce a heat-treated steel product containing fom 10 to 35% MLB by volume because of the relationship of such structure to high strength and excellent formability.

A still further object is to provide a heat-treating process that will routinely develop the desired microstructure and mechanical properties of the invention.

It is also an object of the invention to provide a high-strength heat-treated steel article capable of being easily formed into complex parts.

These and other objectives and advantages will become more apparent to those skilled in the art from the following description of the invention.

FIG. 1 generally depicts the improvement in uniform elongation at given ultimate tensile strength levels for steels of the invention as contrasted to those having a ferrite-pearlite microstructure.

Figure 1:
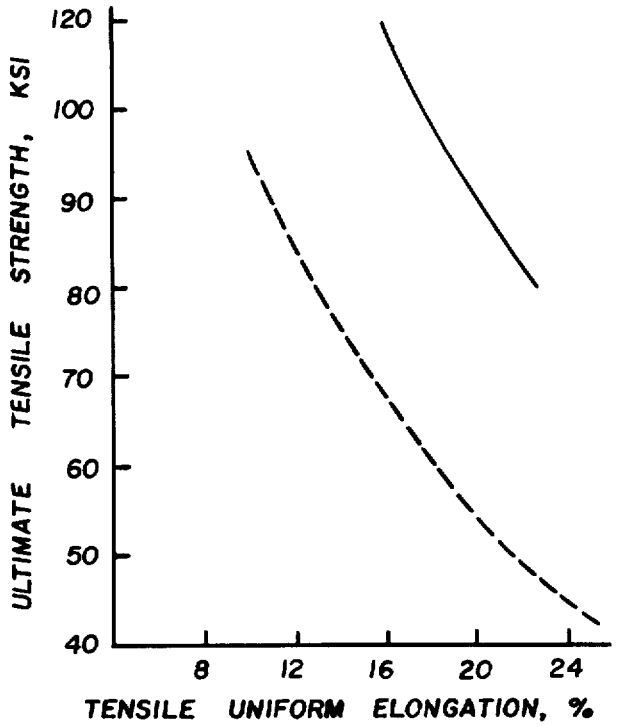

It has been discovered that the objectives of the inventionmay be attained through a balance of chemical composition and heat treatment. The following general chemical composition is applicable: carbon, 0.04 to 0.17%; manganese, 0.8 to 2.0%; silicon, up to 1.0%; vanadium, up to 0.12%; columbium, up to 0.1%; titanium, up to an effective amount to form titanium carbo-nitrides; nitrogen, 0.001 to 0.025% and balance essentially iron.

Carbon is generally maintained between about 0.04 and 0.17%. Lowering carbon content below about 0.04% requires relatively large quantities of manganese to attain a minimum ultimate tensile strength of 80,000 p.s.i. and thus decreasing carbon below this level involves disproportionate steelmaking costs. A maximum of 0.17% carbon is selected because higher carbon levels impair spot weldability fr light gauge materials. It is preferred to maintain carbon between 0.10 and 0.12% to further optimize steelmkaing costs and spot weldability although somewhat higher carbon contents are preferred for certain heat-treating embodiments.

Manganese serves to promote product strength and should generally range from about 0.8 to 2.0%. A manganese content of about 0.8% is required to achieve desired minimum 80,000 p.s.i. tensile strength in combination with the carbon content and cooling rates of the invention. Manganese contents in excess of about 2.0% are not economically attractive.

Silicon may be included in the composition of the invention in amounts up to approximately 1.0% as this element appears to contribute to strengthening. Typically, amounts of from about 0.2 to 0.5% are contemplated.

Vanadium may be optionally included in quantities up to about 0.12%. This alloying element promotes the formation of fine grained austenite during the initial stage of the heat-treatment and thus is generaly effective in strengthening the product. The strengthening mechanism is believed to involve the formation of vanadium carbo-nitrides which function to retard grain growth. Quantities in excess of about 0.12% vanadium do not appreciably improve strength and involve unrealistic cost considerations. Typically, vanadium, if present, may be included in amounts on the order fom 0.04 to 0.12%.

Columbium, like vanadium, is a grain refining element, principally through formation of carbo-nitrides, and may be optionally included in amounts up to 0.1%. A range of from about 0.01 to 0.04% is considered to represent a reasonable balance between grain refining effect and cost.

Titanium also functions as a carbo-nitride former and may be optionally present in the composition of the invention for the same reasons as vanadium and columbium. This alloying element may be present in amounts effective to form titanium carbo-nitrides. Such effective amounts may range up to about 0.1%. The absolute amount of titanium required to perform the above stated function cannot be stated with exactness because titanium will combine with elements such as oxygen and sulfur prior to nitrogen and carbon. As a consequence, the amount of titanium free to combine with carbon and nitrogen is dependent upon the degree of deoxidation when titanium is added to the steel as well as the sulfur content of the steel. Additionally, the presence and relative amounts of elements such as rare earths enter into the degree to which titanium is able to form carbo-nitrides. However, those skilled in the art are well able to recognize and compensate for such factors and would have no difficulty in determining an effective amount of titanium required for a give alloy composition within the scope of the invention.

Nitrogen may be present in amounts ranging from about 0.001 to 0.025%. It is therefore within the scope of the invention to include steels having nitrogen contents in amounts representative of normal residual quantities as well as renitrogenized steels.

If the steel of the invention is in the killed condition, aluminum should be present in amounts from about 0.01 to 0.2%. However, lower states of deoxidation are within the scope of the invention. The killed deoxidation state is recommended if sulfide shape control additives such as rare earths, zirconium, and titanium are present. Rare earths or rare earth mixtures in amounts from 0.01 to 0.10% are contemplated for steels having sulfur contents below about 0.025%. U.S. Pat. No. 3,671,336 contains considerable detail regrading the role of sulfide shape control additives and is hereby incorporated by reference for such purpose.

The above described composition may be conventionally manufactured into a convenient intermediate product such as plate or coil and then subjected to the following heat treatment: heat to a temperature above the $Ac_3$ temperature of the steel for a time sufficient to completely austenitize the steel and then cool the steel at a rate related to steel composition. This procedure results in a product characterized by minimum ultimate tensile strength of 80,000 p.s.i. and a minimum tensile uniform elongation of 16%. The as heat-treated microstructure comprises from about 10 to 35% by volume of MLB with a balance essentially of proeutectoid ferrite. However, minor amounts of high temperature transformation products such as upper bainite and pearlite may be present provided that such microconstituents do not adversely influence the desired combination of mechanical properties.

Figure 2:
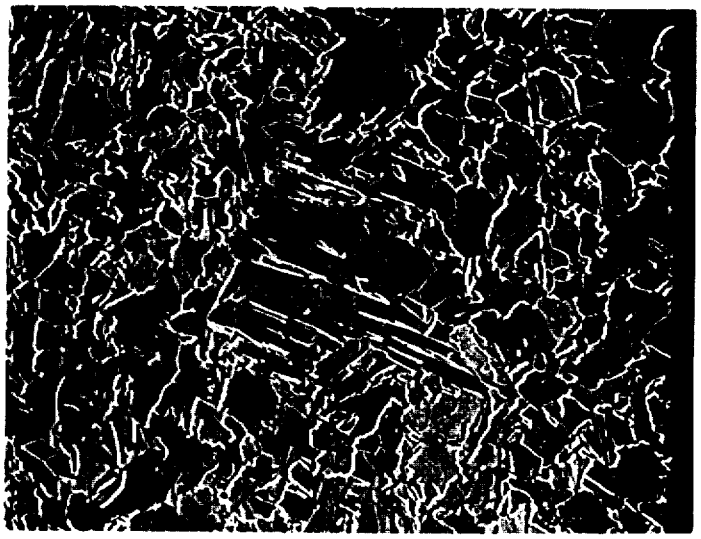
FIG. 2 is a scanning electron micrograph taken at a magnification of 2000 X which illustrates a typical microstructure of the product in the as heat-treated metallurgical condition.

The term "MLB", as used in the context of the invention, pertains to lower temperature transformation products that form directly from austenite upon cooling at a temperature on the order of about 850 F or lower and are commonly referred to as acicular martensite, lath martensite, lower bainite, etc. MLB transformation products typically have a Vickers hardness of 400 or higher. FIG. 2 is a scanning electron micrograph, taken at a magnifiction of 2000X after etching in a 2% nitol solution, illustrative of a typical microstructure of the product of the invention.

Figure 3:
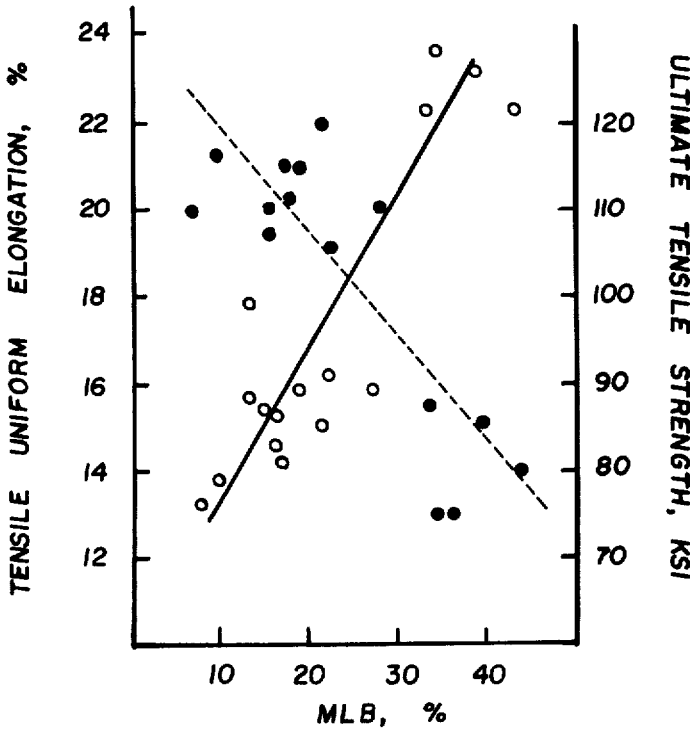
FIG. 3 is a plot of ultimate tensile strength and uniform elongation as a function of % MLB.

The significance of volume percent of MLB for achieving the unique combination of strength and formability of the invention is illustrated by the two curves presented in FIG. 3. Ultimate tensile strength, represented by the solid lined curve and open circle data points, increases with increasing percent of MLB. A minimum of about 10% MLB is required to obtain the desired minimum tensile strength of 80,000 p.s.i. On the other hand, formability, as represented by the dashed lined curve and closed circle data points, decreases with increasing percent of MLB. A maximum of about 35% MLB is required to obtain the desired minimum of 16% uniform elongation. It is preferred to restrict the volume percent of MLB to about 15 to 25% as such portion of the overall range favors formability and leads to tensile strength on the order of 85,000 p.s.i. minimum. A tensile strength of 80,000 p.s.i. minimum represents a commercially attractive strength level for steels of the type of the invention and a minimum uniform elongation of 16% provides for good formability for such strength level. Such combination of mechanical properties is extremely desirable for applications involving high strength steels.

Steel products having the microstructure and resultant mechanical properties of the invention may be produced by conventional steelmaking techniques including but not limited to the basic oxygen process, electric furnace, or open hearth. Steel slabs or billets are then produced by blooming or continuous casting followed by hot strip, or bar mill rolling to plate, coil, or bar form. A convenient technique of hot rolling is the procedure taught in U.S. Pat. Nos. 3,666,452 and 3,671,336. Following hot rolling the product is subjected to pickling and cold rolling or the like. In any event, an intermediate product in the hot-rolled or cold-rolled metallurgical condition is suitable for subsequent heat-treatment in accordance with the invention.

Steel products having the mechanical properties of the invention may be produced through the relatively simple two-stage heat-treatment set forth below.

The first stage involves heating the steel to above its $Ac_3$ temperature for a time sufficient to fully transform the prior microstructure to austenite. This procedure involves several advantages when contrasted with procedures involving the formation of partial quantities of austenite by heating to between the $Ac_1$ and $Ac_3$ temperatures of the steel and then transforming such austenite to lower transformation products. The kinetics involved in austenite transformation are such that equilibrium is approached much more rapidly at higher temperatures. Hence, a significant reduction in the time required to form austenite is realized. This factor is of considerable commercial importance in a continuous heat-treating line. Secondly, full austenization facilitates process control to a considerable extent because partial austenization through intercritical annealing involves quite rigid control of time and temperature due to the rather narrow combination of times and temperatures available in conventional continuous heat-treating lines for forming a give amount of austenite.

Austenization is accomplished through heating the steel to a temperature in excess of its $Ac_3$ temperature for a time sufficient to cause full austenization. It is preferred to limit this temperature to a maximum of about 1750° F to avoid excessive austenite grain growth. However, this temperature may be exceeded if short times are employed or if grain refining elements such as vanadium, columbium, or titanium are included in the steel. The steels of this invention are typically fully austenized by continuous passage through a continuous annealing furnace chamber maintained at less than 1750° F for times from 1 to 4 minutes dependent upon strip thickness.

Following austenization, the steel may be force cooled at a rate of less than about 70° F/sec. to a temperature of about 850° F and then further force cooled at a rate of greater than about 10° F/sec. to complete transformation from austenite to the desired amount of MLB and proeutectoid ferrite. Force cooling involves cooling rates in excess of those encountered through cooling in still air and may be accomplished by continuous contact of the strip with steam, gas jets, water sprays, mists, etc. In general, it is preferred to cool the strip as fast as possible within the constraints mentioned above so as to minimize cooling zone length. As discussed later, certain cooling rates outside the above discussed limits may be employed for steels of restricted composition.

It is within the scope of the invention to vary forced cooling rates within the constraints described above during each of the stages or to vary the cooling rate following the first stage. However, one may simply use a constant cooling rate during each stage. In this instance a range of from 10° to 70° F/sec. must be employed to satisfy the criteria for both stages. In general, it is preferred to cool the product at a rate falling within the faster position of the range as shorter lengths or cooling zones are required when the process is performed in a continuous manner.

Figure 4:
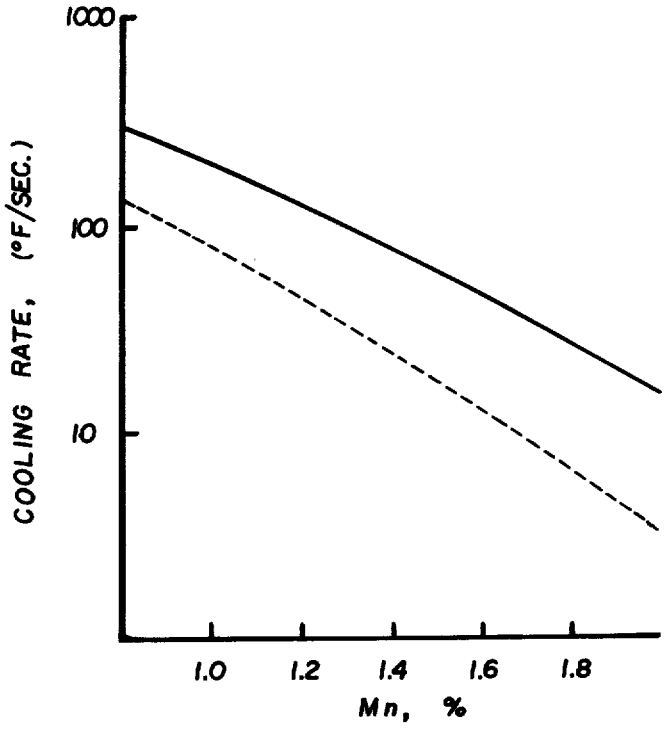
FIG. 4 is a plot of cooling rate as a function of manganese content for two carbon levels.

The choice of a given cooling rate, forced or otherwise, is also related to the carbon and manganese content of the steel. FIG. 4 is a plot of cooling rate versus manganese content for two carbon levels. The solid lined curve represents the rate required to achieve an ultimate tensile strength of about 89 k.s.i. for steels having 0.11% carbon. The dashed line curve indicates the same strength level for 0.15% carbon steel. The two steels used in obtaining the underlying data were killed and contained 0.4% silicon, 0.05% vanadium, and 0.012% nitrogen. As may be seen, higher carbon contents, at a given manganese content, lead to the ability to use a slower cooling rate to attain equivalent strength levels. Therefore, one should take manganese and carbon content into consideration during the selection of a specific cooling rate.

Figure 5:
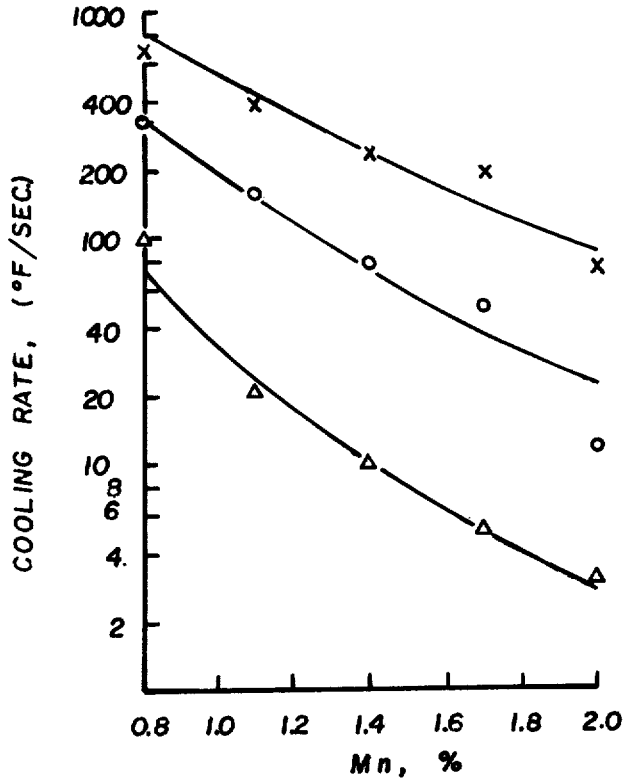
FIG. 5 is a graphical representation of the relationship between cooling rate required to obtain ultimate tensile strengths of 80,000 p.s.i. or greater and manganese content of the steel.

FIG. 5 is a plot of cooling rate versus manganese content for killed steels having the following aim compositions: 0.11% carbon, 0.4% silicon, 0.05% vanadium, and 0.012% nitrogen. Manganese content was varied at the five levels shown in the figure. The three curves, from the upper to lower portion of the figure, represent ultimate strength levels of 101 k.s.i., 89 k.s.i., and 80 k.s.i., respectively. Data supporting the curves was obtained from hardness measurements taken along the length of five end-quenched bar specimens having been first heated to 1625° F to achieve complete austenization. Hardness measurements were taken at locations appropriate to approximate the plotted cooling rate. The curves indicate the interplay between cooling rate and percent manganese and, taken in combination with the relationship expressed in FIG. 4, provided a reliable description of the factors required to achieve the minimum strength level of the invention. Multiple regression analysis of the data underlying the curves indicate that the three variables are related in the following manner:

$$UTS = 32.186 + 8.891 \log CR + 0.026\ Mn \times CR + 160.561\ C + 14.173\ Mn;$$

wherein,

UTS = Ultimate Tensile Strength, k.s.i.,
CR = Cooling Rate, °F/sec.,
Mn = % Manganese, and
C = % Carbon By setting ultimate strength equal to or greater than 80 k.s.i., it is then a matter of simple calculation to select the combination of cooling rate, manganese content, and carbon content required to obtain the desired strength level.

For example, an ultimate tensile strength of 80 k.s.i. minimum would be calculated in accordance with the following relationship:

$$80 \geq 32.186 + 8.891 \log CR + 0.026\ Mn \times CR + 160.561\ C + 14.173\ Mn$$

As follows from the above relationship, certain combinations of chemical compositions and cooling rates may be used to obtain the mechanical properties of the invention. Such composition and rates involve the use of forced or slower cooling procedures.

Forced cooling in accordance with the rates described previously may be utilized for the general chemical composition described herein. Continuous heat-treating having the capability to achieve force cooling rates constitute a preferred apparatus for practice of the invention. Accordingly, compositional factors should be adjusted so as to be compatible with the typical forced cooling rates obtainable by such equipment. Using the principles developed from FIGS. 4 and 5, the following compositional range is preferred when forced cooling equipment is utilized: 0.10 to 0.12% C, 1.2 to 1.4% Mn, 0.3 to 5% Si, up to 0.12% V, up to 0.1% Cb, up to an effective amount of Ti to form titanium carbo-nitrides, 0.001 to 0.025% N, balance essentially Fe.

On the otherhand, compositions involving carbon and manganese contents toward the higher portions of the general range are compatible for use with heat-treating facilities that do not provide for forced cooling. Consequently, slower cooling rates on the order of 3° to 10° F/sec. are necessarily involved. To compensate for equipment limitations, the following steel composition is necessary: 0.10 to 0.17%C, 1.5 to 2.0% Mn, 0.3 to 1.0% Si, up to 0.12% V, up to 0.1% Cb. up to an effective amount of Ti to form titanium carbo-nitrides, and 0.001 to 0.025% N, balance essentially Fe. As in the instance of forced cooling, the cooling rate for this embodiment may be varied within the 3° to 10° F/sec. range during the cooling cycle from the austenizing temperature to room temperature.

While it is conceivable that the process of the invention could be performed as a batch heat-treatment, it is preferred to continuously pass a strand or strip of the material through a continuous annealing type furnace. The times and temperatures required by the treatment are well within the capabilities of commercially available facilities and, hence, continuous heat-treatment is a practical and economical mode of treatment.

The following examples are included for purposes of illustrating typical process embodiments of the invention.

EXAMPLE 1

A 0.125 inch thickness strip in the hot-rolled condition and having a composition of 0.11%C, 1.35% Mn, 0.43% Si, 0.12% V, 0.013%N, 0.059% Al, balance essentially Fe was heated to 1550° F for 100 seconds to fully austenitize the steel and then cooled to room temperature at three different uniform rates, i.e., about 10° F/sec., about 70° F/sec. and greater than about 400° F/sec. The heat-treated steel strip cooled at a rate of about 10° F/sec. exhibited an ultimate tensile strength of 83 k.s.i., a yield strength of 60 k.s.i., a tensile uniform elongation of 21%, and a total elongation in 2 inches of 28%. The strip cooled at about 70° F/sec. had an ultimate tensile strength of 96 k.s.i., a yield strength of 46 k.s.i., a tensile uniform elongation of 21%, and a total elongation in 2 inches of 27%. Both of the above trials demonstrate that the desired combination of ultimate tensile strength and uniform elongation are attainable through use of cooling vanadium-containing steels of the composition of the invention at uniform rates between 10° F/sec. and 70° F/sec. On the other hand, the trial involving a severe cooling rate of greater than 400° F (water quenched) produced an ultimate tensile strength of 142 k.s.i., a yield strength of 74 k.s.i., a tensile uniform elongation of 5%, and a total elongation in 2 inches of 6%. The latter trial demonstrates that severe cooling rates do not lead to the desired uniform elongation and formability.

EXAMPLE 2

A 0.190 inch thickness strip in the hot-rolled condition and having a composition of 0.10% C, 1.76% Mn, 0.79% Si, 0.007% N, 0.097% Al, balance essentially Fe was austenitized at 1500° F for 50 seconds and uniformly cooled to room temperature at a rate of about 5° F/sec. The heat-treated strip exhibited an ultimate tensile strength of 88 k.s.i., a yield strength of 43 k.s.i., a tensile uniform elongation of 22%, and a total elongation in 2 inches of 32%. This example demonstrates the operability of compositions that do not contain austenite grain refining elements such as vanadium, columbium or titanium. In addition, the example indicates that cooling rates lower than those employed in typical force cooling embodiments of the invention may be used provided that carbon and manganese are maintained at relatively high levels.

EXAMPLE 3

A 0.110 inch strip having a composition of 0.12% C, 1.31% Mn, 0.48% Si, 0.12% V, 0.016% N, 0.10% Al, balance essentially Fe was processed on a conventional force cooling heat-treating line by passing the strip through an austenizing chamber maintained at approximately 1625° F for a time of 112 seconds. Following austenization, the strip was cooled at a rate of about 30° to about 850° F and then water quenched (a cooling rate greater than about 400° F/sec.) to ambient temperature. An ultimate tensile strength of 94 k.s.i., a yield strength of 53 k.s.i., a tensile uniform elongation of 21%, and a total elongation in 2 inches of 27% was obtained. This example demonstrates that the desired mechanical properties may be obtained through cooling to 850° F at a rate less than 70° F/sec. and cooling at a rate of greater than 10° F/sec. thereafter when a composition in accordance with that of the invention is used.

We claim:

1. A method of heat treating steel to produce a high strength product having high tensile uniform elongation, comprising:
   a. heating a steel product having a composition consisting essentially of from 0.04 to 0.17% carbon, 0.8 to 2.0% manganese, up to 1.0% silicon, up to 0.12% vanadium, up to 0.1% columbium, up to an effective amount of titanium to form titanium carbo-nitrides, 0.001 to 0.025% nitrogen, balance iron to a temperature above the $Ac_3$ temperature of the steel for a time sufficient to austenitize said steel product;
   b. cooling said austenitized steel product at a rate of no more than about 70° to about 850° F; and
   c. cooling said steel product at a rate of more than about 10° from 850° F to obtain a high-treated steel product having a minimum ultimate tensile strength of 80,000 p.s.i., a minimum tensile uniform elongation of 16%, and a microstructure of from about 10% to 35% MLB, balance essentially proeutectoid ferrite.

2. The method of claim 1, wherein:
said steel product is heated to from between its $Ac_3$ temperature to about 1750° F.

3. The method of claim 1, wherein:
said fully austenized steel product is cooled at a rate from about 10° to 70° F so as to obtain said microstructure.

4. The method of claim 1, wherein:
said steel product is in the hot-rolled condition prior to heat-treatment.

5. The method of claim 1, wherein:
said fully austenized steel product is cooled in accordance with the following relationship:

$$80 \geq 32.186 + 8.891 \log CR + .026\ Mn \times Cr + 160.561\ C + 14.173\ Mn;$$

wherein,

CR = Cooling Rate, °F/sec.;

Mn = Manganese, %; and

C = Carbon, %.

6. A method of heat treating steel to produce a high strength product having high tensile uniform elongation, comprising:

a. continuously heating a steel product having a composition consisting essentially of from 0.10 to 0.12% carbon, 1.2 to 1.4% manganese, 0.3 to 0.5% Si, up to 0.12% vanadium, up to 0.1% columbium, up to an effective amount of titanium to form titanium carbo-nitrides, 0.001 to 0.025% nitrogen, balance iron to a temperature above the $Ac_3$ temperature of the steel for a time sufficient to austenize said steel product;

b. continuously force cooling said austenitized steel product at a rate of no more than about 70° F/sec. to about 850° F; and c. continuously force cooling said steel product at a rate of more than about 10° F/sec. from 850° F to obtain a heat-treated steel product having a minimum ultimate tensile strength of 80,000 p.s.i., a minimum tensile uniform elongation of 16%, and a microstructure of from about 10% to 35% MLB, balance essentially proeutectoid ferrite.

7. A method of heat treating steel to produce a high strength product having high tensile uniform elongation, comprising:

a. heating a steel product having a composition consisting essentially of from 0.10 to 0.17% carbon, 1.5 to 2.0% manganese, 0.3 to 1.0% silicon, up to 0.12% vanadium, up to 0.1% columbium, up to an effective amount of titanium to form titanium carbo-nitrides, 0.001 to 0.025% nitrogen, balance iron to a temperature above the $Ac_3$ temperature of the steel for a time sufficient to austenize said steel; and b. cooling said austenitized steel product at a rate of from 3° to 10° F/sec. to obtain a heat-treated steel product having a minimum ultimate tensile strength of 80,000 p.s.i., a minimum tensile uniform elongation of 16%, and a microstructure of from about 10% to 35% MLB, balance essentially proeutectoid ferrite.

* * * * *